US007573392B2

(12) United States Patent
Leach et al.

(10) Patent No.: US 7,573,392 B2
(45) Date of Patent: Aug. 11, 2009

(54) BACKDRAFT DETECTOR

(75) Inventors: Jonathan W. Leach, Killingworth, CT (US); Charles T. Pearson, Northford, CT (US)

(73) Assignee: Honeywell International Inc., Morristown, NJ (US)

( * ) Notice: Subject to any disclaimer, the term of this patent is extended or adjusted under 35 U.S.C. 154(b) by 267 days.

(21) Appl. No.: 11/466,559

(22) Filed: Aug. 23, 2006

(65) Prior Publication Data

US 2008/0048853 A1 Feb. 28, 2008

(51) Int. Cl.
*G08B 17/10* (2006.01)

(52) U.S. Cl. ..... 340/632; 340/584; 340/825.54

(58) Field of Classification Search ..... 340/584, 340/539, 628, 629, 331, 332, 531, 825.06, 340/825.36, 825.54, 632
See application file for complete search history.

(56) References Cited

U.S. PATENT DOCUMENTS 4,751,912 A * 6/1988 Monette ..... 126/307 A
4,850,264 A * 7/1989 Kiser ..... 454/255
4,924,785 A * 5/1990 Schultz et al. ..... 110/346
4,960,041 A * 10/1990 Kiser ..... 454/238
5,203,687 A * 4/1993 Oguchi ..... 431/14
5,456,064 A * 10/1995 Graves ..... 60/276
5,997,279 A * 12/1999 Hosome et al. ..... 431/76
6,133,839 A * 10/2000 Ellul et al. ..... 340/584
6,392,536 B1 * 5/2002 Tice et al. ..... 340/506
6,551,383 B1 * 4/2003 Richardson et al. ..... 95/90
7,010,461 B2 * 3/2006 Draxton et al. ..... 702/182
2004/0035461 A1 * 2/2004 Susko ..... 137/209

* cited by examiner

*Primary Examiner*—Benjamin C Lee
*Assistant Examiner*—Daniel Previl
(74) *Attorney, Agent, or Firm*—Husch Blackwell Sanders Welsh & Katz

(57) ABSTRACT

A backdraft detector incorporates at least one oxygen sensor in combination with a flow sensor. Both sensors are coupled to control circuitry which evaluates sensed oxygen levels of a flowing sample being monitored by the flow sensor.

19 Claims, 1 Drawing Sheet

BACKDRAFT DETECTOR

FIELD OF THE INVENTION

The invention pertains to ambient condition detectors. More particularly, the invention pertains to detectors of ambient conditions which are favorable to the development of backdrafts due to the presence of a fire.

BACKGROUND OF THE INVENTION

Systems, known as fire alarm systems, which monitor regions such as buildings to sense the presence of fire conditions are often installed in commercial buildings, residences and the like. Such systems usually incorporate a common control element, a fire alarm panel, which is coupled via cables or via RF to a plurality of ambient condition detectors. The ambient condition detectors can include fire, smoke and gas detectors all without limitation.

Detectors of the type noted above generally are not intended to sense and indicate to the fire alarm control unit the presence of conditions which favor backdrafts. Backdrafts can occur in circumstances where the oxygen in a room has been depleted due to a fire, but the fuel and smoke remain at a high temperature.

When first responders, such as firefighters, respond to a fire alarm and encounter a closed room where the oxygen has been depleted, opening a door or a window into the room can feed the fire therein with additional oxygen. This can in turn produce a sudden, very extensive burst of flame as fire produced gases heat and expand due to the inflowing oxygen) which can erupt from the opening and envelop the firefighters causing death or serious personal injury.

There thus is an ongoing need to be able to determine, prior to attempting to open or enter closed rooms, whether the conditions are present to support a backdraft. Preferably such detectors could be readily installed in the same regions or buildings with other ambient condition detectors and fire monitoring systems and coupled thereto. It would also be desirable if such detectors could be configured so as to be installable at a distance from the closed room or region which is to be monitored for the backdraft condition.

DETAILED DESCRIPTION

Figure 1:
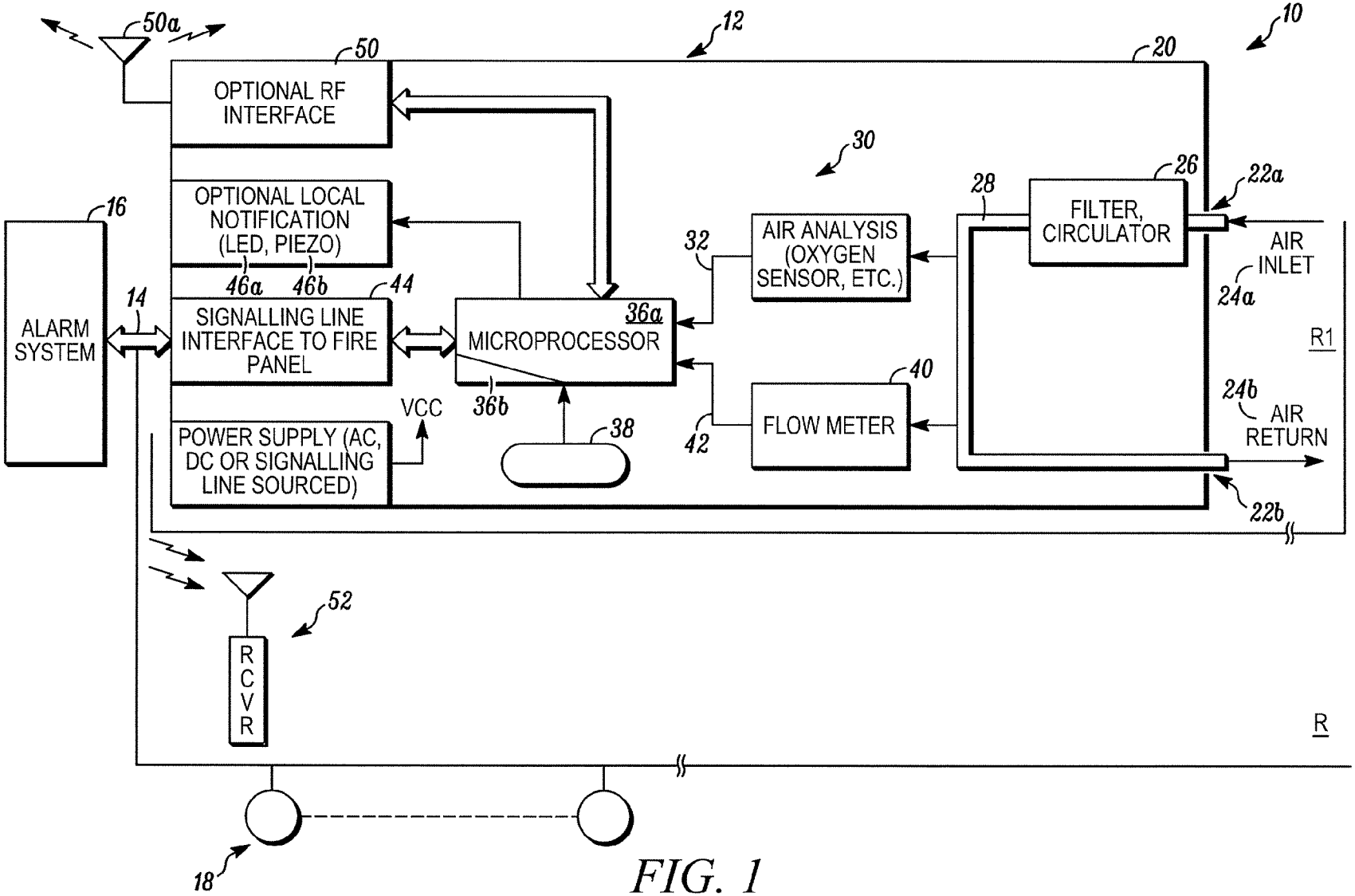
FIG. 1 illustrates a system in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention reduce the dangers of unexpected backdrafts by detecting conditions favorable to such an event. Those conditions can then be reported to a local fire alarm or monitoring system.

In one aspect of the invention, a set of sensors could be monitored locally at a backdraft condition detector. Where the sensed conditions support the possibility of a backdraft developing in the presence of additional oxygen, the respective detector could signal the local alarm system. Additionally, both visual and audible alarms can be provided locally to alert first responders to the presence of the potential backdraft.

Wireless signals, such as RF, could also be emitted which could be detected by an appropriate receiver. For example, first responders could be equipped with RF receivers which respond to the backdraft indicating signals from the respective detectors. The fire alarm control panel could also incorporate an appropriate wireless detector.

A detector which embodies the invention can incorporate an oxygen sensor, for example, which can be coupled to control circuitry. That sensor responds to a depleted level of oxygen in a region or room being monitored. The detector could also include a temperature sensor as a secondary source of data on room conditions. A backdraft indicating communication pathway could be provided to a local alarm system, either wirelessly or via cables. The detector can also indicate audibly and visibly in an area local thereto that a condition potentially supporting backdraft has been sensed.

A detector in accordance with the invention could incorporate a sensor block having an air inlet and an air outlet, or return for the air, in the region which is being monitored. A circulator, for example a fan, can be incorporated to suck or draw the air to be sensed through the inflow port. The inflowing air can be filtered to minimize particulate interference with the sensors.

The filtered inflowing air can be circulated past one or more oxygen level sensors as well as past a flow meter or sensor. The oxygen sensors can be used to evaluate the level of oxygen in a closed room or region from which the samples being evaluated have been extracted. The flow sensor confirms that inflowing air is circulating past the oxygen sensor or sensors.

In another aspect of the invention, the detector body itself could be displaced from the inflow/outflow ports and the room or region being monitored so as to protect the device from fire or backdraft conditions which may develop in that room or region. A local control element could incorporate a programmed processor and associated executable instructions to evaluate signals or inputs from the oxygen and flow sensor or sensors.

A thermal sensor can be incorporated in the detector. Processing can be carried out relative to both a high temperature indication and a low oxygen level to establish a possible backdraft condition.

The control element can be coupled to a signaling interface which would, via a wired or wireless medium, communicate with the local alarm system. Alternately, the backdraft detector can incorporate local visible and audible output devices, and associated driving circuitry, which can be driven to provide a visual or an audible indication of a sensed backdraft condition. An RF interface and associated antenna could be provided to transmit RF warning signals to the fire alarm control unit, or alternately, to RF receivers worn by first responders to provide them with an additional warning as to the presence of a potential backdraft condition.

In a method in accordance with the invention, air samples can be extracted from a room being monitored for backdraft conditions. Airflow can also be measured in order to verify that a valid sample is being tested. The oxygen sensors could measure oxygen content in the air. Indicators of the oxygen content can be forwarded to a local control element. The local control element can provide an alarm indication to a local alarm monitoring system indicating that a backdraft condition has been detected. Additionally, wireless alarm signals could be emitted to provide additional information to first responders.

In another aspect of the invention, the detector could carry out self-tests on a periodic and ongoing basis to determine that it is functioning properly. Error indicators can be forwarded to the local alarm system indicating that the detector may need maintenance or service.

FIG. 1 illustrates a system 10 which includes at least one backdraft condition detector 12. Detector 12 can communicate alarm conditions via a wired or wireless medium 14 to a local fire alarm or ambient condition monitoring system 16. Elements of system 16 can be distributed throughout a region R being monitored.

Those of skill will understand that a plurality of backdraft condition detectors, substantially identical to the detector 12, can be scattered about in a region being monitored. All such detectors could in turn communicate with the control element of a local fire alarm monitoring system, such as system 16, as illustrated in FIG. 1.

The system 10 can also include a plurality of ambient condition detectors 18. Members of the plurality 18 can include smoke detectors, fire detectors, gas detectors, all without limitation. System 10 can also include one or more backdraft detectors, such as detector 12 coupled to medium 14.

Backdraft monitor, or detector, 12 can incorporate a housing 20, an inflow 22*a* for air from an enclosed room or subregion R1 of region R being monitored, and an outflow 22*b*. It will be understood that the actual air inlet 24*a* and air return 24*b* could be located in a room being monitored. In this instance the detector 12 could be displaced from the air inlet and air return outlet 24*a, b* by pipes or hoses.

The detector 12 can incorporate a filter/circulation unit 26 which can draw air being monitored in via air inlet 24*a* to the detector 12. Conduits such as the conduit 28 can be incorporated into the housing 12 to provide an airflow pathway.

Detector 12 can incorporate one or more oxygen sensors indicated generally at 30. The sensors 30 are operatively exposed to inflowing air in the conduit 28. Sensors 30 output electrical signals indicative of sensed oxygen levels of the inflowing air via line 32. Such signals can in turn be coupled to a programmed processor 36*a*.

Control software or executable instructions 36*b* stored in read-only memory or electrically erasable read-only memory in combination with the processor 36*a* can process the output signals from the sensors 30 and thermal sensor 38. Processing could include comparing one or more oxygen levels and temperatures to respective threshold(s). Alternately, profile evaluation or pattern recognition-type processing could also be used taking into account both oxygen level and temperature.

A flow sensor or flow meter 40 can be coupled to the conduit 28 for confirmation that inflowing air continues to circulate from the air inlet 24*a* via conduit 28 to the air return outlet 24*b*. Output signals from the flow meter 40 can be coupled via conductor 42 to the processor 36*a* to establish that air being sampled is in fact flowing from the room being monitored and then returning thereto.

Processor 36*a* can be coupled via an interface 44 and the medium 14 to the respective alarm system 16. Local visible indicators 46*a* and audible indicators 46*b* can be coupled to processor 36*a* to provide local feedback to first responders in the vicinity of detector 12 as to a sensed backdraft condition.

An RF interface 50 can be coupled to processor 36*a* to provide wireless backdraft indicating signals via an antenna 50*a* to either the alarm system 16 or to a RF receiver 52 of a type which could be worn or carried by first responders in the vicinity of the room being monitored.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A backdraft detector comprising:

at least one backdraft indicating oxygen sensor;

a temperature sensor;

an air inflow conduit and an air outflow conduit for acquiring samples from a displaced location and for returning samples to the displaced location, the acquired samples are exposed to the at least one oxygen sensor; and control circuitry coupled to the sensors, the control circuitry evaluates an oxygen level of the acquired samples to which the sensor has been exposed, as well as ambient temperature, to determine a presence of conditions favorable to a backdraft.

2. A detector as claimed in claim 1 which includes an interface coupled to the control circuits for emitting a backdraft condition indicating indicium to a displaced location.

3. A detector as in claim 2 where the interface includes circuitry coupleable to at least one of a wired medium, a wireless transmitter, a visual alarm indicating element or an audible alarm indicating element.

4. A detector as in claim 1 where the control circuitry includes a programmable processor and associated control software for evaluating the oxygen level of the sample to which the oxygen sensor has been exposed.

5. A detector as in claim 1 which incorporates a device to move air into a region where it can be exposed to the oxygen sensor.

6. A detector as in claim 5 where the device includes an electro-mechanical air mover and a filter.

7. A detector as in claim 6 which includes a housing; the housing carries therein the oxygen sensor, the control circuitry and the electro-mechanical air mover.

8. A detector as in claim 7 where the housing defines an air sample inflow port, and a conduit which couples in-flowing air to the oxygen sensor.

9. A detector as in claim 8 which includes a flow sensor.

10. A detector as in claim 9, where the flow sensor is coupled to both the conduit and the control circuitry.

11. A detector as in claim 1 which includes a device, located in one of the conduits, for moving air in the inflow conduit to a region where it can be exposed to the oxygen sensor.

12. A detector as in claim 1 where the control circuitry implements at least one of a comparison of a sensed oxygen level to a predetermined threshold, pattern recognition processing of a plurality of sensed oxygen levels, or fuzzy logic processing of one or more sensed oxygen levels.

13. A detector as in claim 1 where the control circuitry includes a programmable processor and associated control software for evaluating the oxygen level of the sample to which the oxygen sensor has been exposed and where the control circuitry implements at least one of a comparison of a sensed oxygen level to a predetermined threshold, pattern recognition processing of a plurality of sensed oxygen levels, or fuzzy logic processing of one or more sensed oxygen levels.

14. A detector as in claim 1 which includes a flow sensor.

15. A system comprising:

a communication medium;

a plurality of ambient condition detectors coupled to the communication medium; and at least one backdraft detector coupled to the communication medium wherein the backdraft detector determines a presence of conditions favorable to a backdraft said backdraft detector includes at least one oxygen sensor and control circuitry coupled to the sensor, the control circuitry evaluates an oxygen level of a sample to which the sensor has been exposed.

16. A system as in claim 15 which includes a common system control element coupled to the communication medium.

17. A system as in claim 16 where the plurality of ambient condition detectors includes at least smoke detectors.

18. A system as in claim 17 which includes a plurality of backdraft detectors.

19. A system as in claim 15 where the control circuitry of the backdraft detector is implemented at least in part with a programmed processor and associated control software, the processor and software implement at least one of a comparison of a sensed oxygen level to a predetermined threshold, pattern recognition processing of a plurality of sensed oxygen levels, or fuzzy logic processing of one or more sensed oxygen levels.

* * * * *